US006379078B1

(12) United States Patent
Zwier

(10) Patent No.: US 6,379,078 B1
(45) Date of Patent: Apr. 30, 2002

(54) METHOD AND APPARATUS FOR PROVIDING AN EDGING STRUCTURE FOR PAVEMENT

(75) Inventor: Daniel G. Zwier, Holland, MI (US)

(73) Assignee: Permaloc Corporation, Holland, MI (US)

( * ) Notice: Subject to any disclaimer, the term of this patent is extended or adjusted under 35 U.S.C. 154(b) by 0 days.

(21) Appl. No.: 09/363,516

(22) Filed: Jul. 29, 1999

Related U.S. Application Data

(63) Continuation-in-part of application No. 09/255,639, filed on Feb. 22, 1999, now abandoned.

(51) Int. Cl.[7] ..... E01C 11/22

(52) U.S. Cl. ..... 404/7; 404/4; 52/102; 47/33

(58) Field of Search ..... 52/102, 169.1; 47/33, 32; 404/4, 7, 18, 28, 31, 36, 43

(56) References Cited

U.S. PATENT DOCUMENTS

| | | | | | |
|---|---|---|---|---|---|
| 4,202,145 | A | * | 5/1980 | Coutler et al. | 52/102 X |
| 4,761,923 | A | * | 8/1988 | Reum et al. | 52/102 |
| 4,863,307 | A | * | 9/1989 | Jones | 404/7 |
| 5,157,867 | A | * | 10/1992 | Fritch | 47/33 |
| 5,212,917 | A | * | 5/1993 | Kurtz et al. | 404/7 X |
| 5,301,461 | A | | 4/1994 | Zwier | |
| 5,377,447 | A | * | 1/1995 | Fritch | 404/7 X |
| 6,030,144 | A | * | 2/2000 | Cannella | 404/7 |
| 6,099,201 | A | * | 8/2000 | Abbrancati | 404/7 |

FOREIGN PATENT DOCUMENTS

| | | | | |
|---|---|---|---|---|
| CA | 1 267 554 | | 4/1990 | |
| DE | 3820436 | * | 1/1989 | 52/102 |

* cited by examiner

*Primary Examiner*—Beth A. Stephan
*Assistant Examiner*—Pat Chavez
(74) *Attorney, Agent, or Firm*—Flynn, Thiel, Boutell & Tanis, P.C.

(57) ABSTRACT

A pavement restraint structure includes edging pieces having apertures. Connecting elements have protrusions that are secured in the edging aperatures such that adjacent edging pieces have a gap therebetween. Anchoring elements are received by slotted apertures in the edging pieces. Thus, the arrangement enables movement, such as contraction and expansion of the edging pieces along a length thereof. Such movement prevents damage to, or improper shifting of the pavement restraint structure with respect to the pavement due to large changes in temperature of the structure.

23 Claims, 4 Drawing Sheets

METHOD AND APPARATUS FOR PROVIDING AN EDGING STRUCTURE FOR PAVEMENT

This is a continuation-in-part of U.S. Ser. No. 09/255,639, filed Feb. 22, 1999, now abandoned.

FIELD OF THE INVENTION

This invention related to a pavement edging assembly and, more particularly, to an asphalt edging structure which includes a plurality of series oriented angled edging pieces and a connecting element for securing the edging pieces to each other. The pavement restraint structure prevents asphalt from moving outwardly and thus varying the width of a paved surface. Thus, the pavement restraint structure improves the appearance of the pavement and prevents movement of the pavement into adjacent unpaved areas by providing edging pieces that block shifting of the pavement.

BACKGROUND OF THE INVENTION

There exists a variety of edging products in the market place. One edging product made of aluminum strips and aluminum staking is taught in U.S. Pat. No. 5,301,461 to Zwier.

It is a well-recognized problem with edging products, particularly in colder climatic areas, where freezing and thawing of earth causes thermal expansion and damage to the edging. Such expansion has the tendency to shift the position or destroy edging over time. One reason for such improper shifting of position or destruction is due to the inability of the edging structure to thermally expand.

Canadian Patent 1 267 554 to Stephen Jones discloses a restraint edge for paving members. The restraint apparatus can be formed from aluminum. The Canadian patent teaches cutting out portions of bottom sections of the restraint apparatus to facilitate bending thereof to form rounded edges and also discloses the use of apertures in the bottom section to enable mounting spikes to secure the edging to a base structure. Paving stone is supported by an outside wall of the restraint apparatus and earth or pavement covers the entirety of the restraint apparatus.

It is an object of the invention to provide a restraint structure comprising multiple elements mounted in series to increase the length of the structure. The multiple elements are secured together such that thermal expansion of the restraint structure due to large changes in temperature of the restraint structure and adjacent materials, does not damage the edging or provide an uneven edge.

SUMMARY OF THE INVENTION

The objects and purposes of this invention have been met by providing a pavement restraint structure having a plurality of angled edging pieces each having a support portion and an edging portion. The support portion and the edging portion are substantially perpendicular with respect to each other. The edging portion has upper and lower slots extending substantially horizontally along a length thereof. The edging portion also includes spaced edging apertures along the length thereof.

The pavement restraint structure also includes connecting elements slidable into the slots of the edging portions of the edging pieces. The connecting elements each include spaced protrusions for connecting respective adjacent edging pieces by being received in respective edging apertures of the edging portions of adjacent edging pieces. The connecting elements and the edging pieces when assembled, form the pavement restraint structure. The connecting elements can connect the edging pieces such that a gap exists between adjacent edging pieces.

A method of assembling and installing such a pavement restraint structure includes arranging edging pieces adjacent each other, securing the pieces to each other by sliding a connecting element into slots at ends of the respective edging pieces, forcing the edging pieces toward each other such that a gap remains between the edging pieces, securing the support portions of the edging pieces to a support bed for the pavement, and applying pavement to cover the support portion of the respective edging pieces, preferably while applying pavement at least to the top of an upper lip of the edging portion of each of the edging pieces. The support bed for the pavement restraint structure can comprise an aggregate base or existing asphalt.

BRIEF DESCRIPTION OF THE DRAWINGS

Other objects and purposes of this invention will be apparent to persons acquainted with an apparatus of this general type upon reading the following specification and inspecting the accompanying drawings, in which.

DETAILED DESCRIPTION

Figure 1:
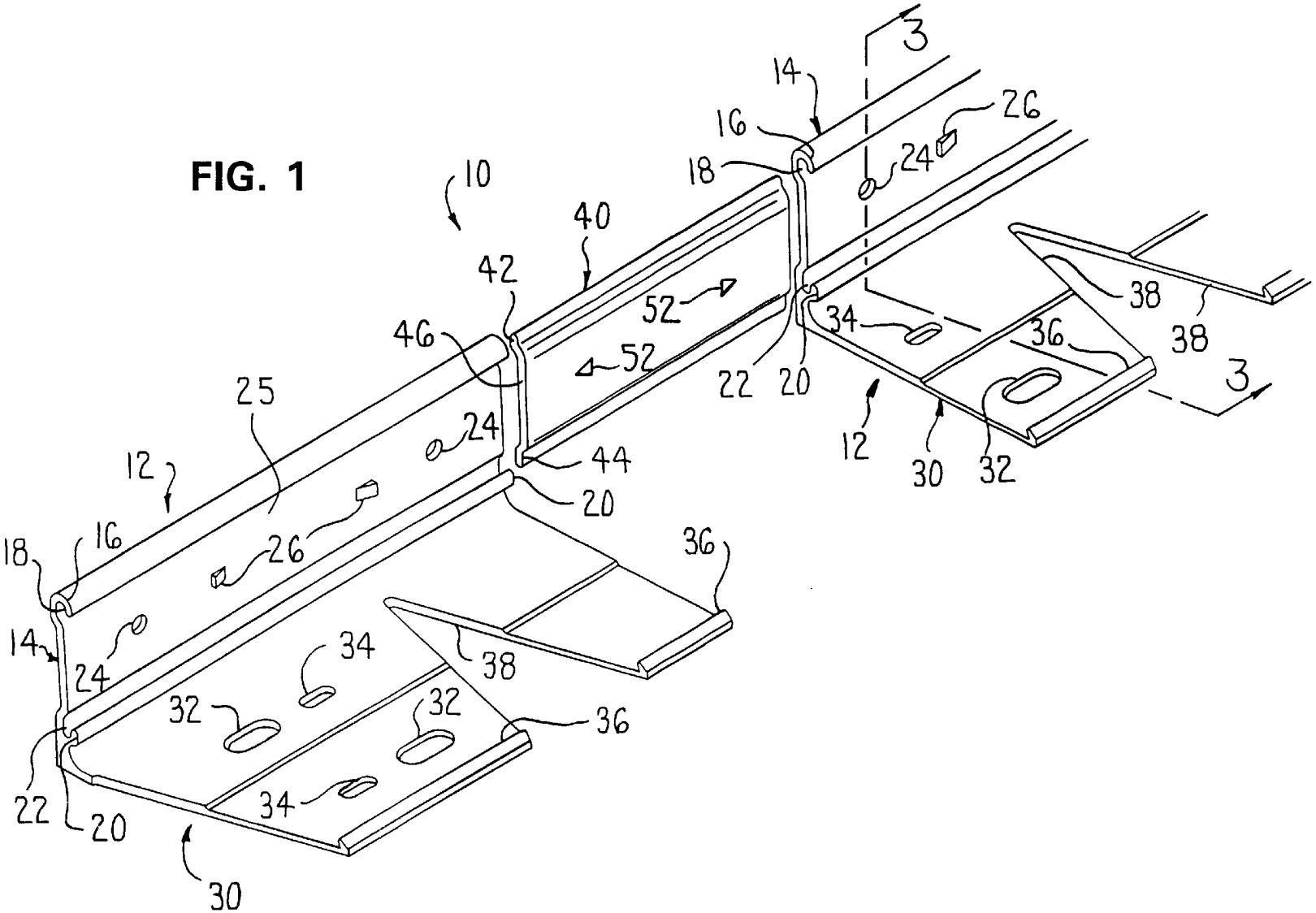
FIG. 1 is an exploded isometric view of a pavement restraint structure embodying the invention.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the pavement restraint structure and designated parts thereof. Such terminology will include derivatives and words of similar importance.

Figure 3:
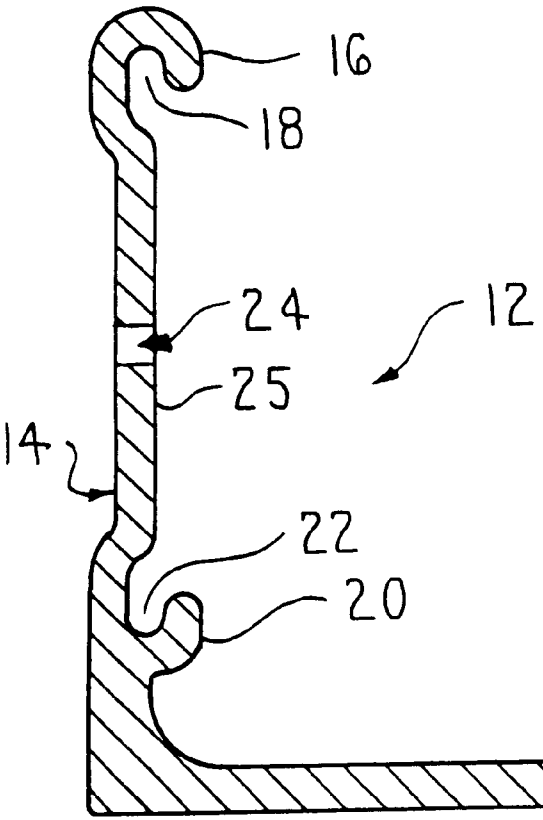
FIG. 3 is a cross-sectional view of an edging piece of the pavement restraint structure taken at 3—3 of FIG. 1.

FIG. 1 illustrates a pavement restraint structure 10 which embodies the invention. More specifically, the pavement restraint structure 10 includes an angled edging piece 12 for preventing the pavement from moving outwardly from the edging piece. The angled edging piece 12 includes an edging portion 14 and a support portion 30. The edging portion 14 and support portion 30 are joined to each other along a length thereof. As shown in FIG. 3, the edging portion 14 and support portion 30 are at a substantially perpendicular angle with respect to each other and, in combination, provide the edging piece 12 with a L-shaped configuration. The edging portion 14 and the support portion 30 preferably are an integral element forming the edging piece 12.

The angled edging piece 12 preferably is made from a metal. Metals have sufficient strength to resist movement of the pavement. More preferably, the angled edging piece 12 is made from aluminum. Aluminum provides a lighter weight than most other metals, enables bending or shaping of the edging piece 12, as needed in forming the restraint structure 10, and allows for thermal expansion of the metal. Aluminum alloys 6005 and 6061 are harder than most aluminum compounds and provide greater product strength and more controlled expansion in response to temperature than most other aluminum alloys. Further, aluminum facilitates manufacture by an extrusion process.

Figure 2:
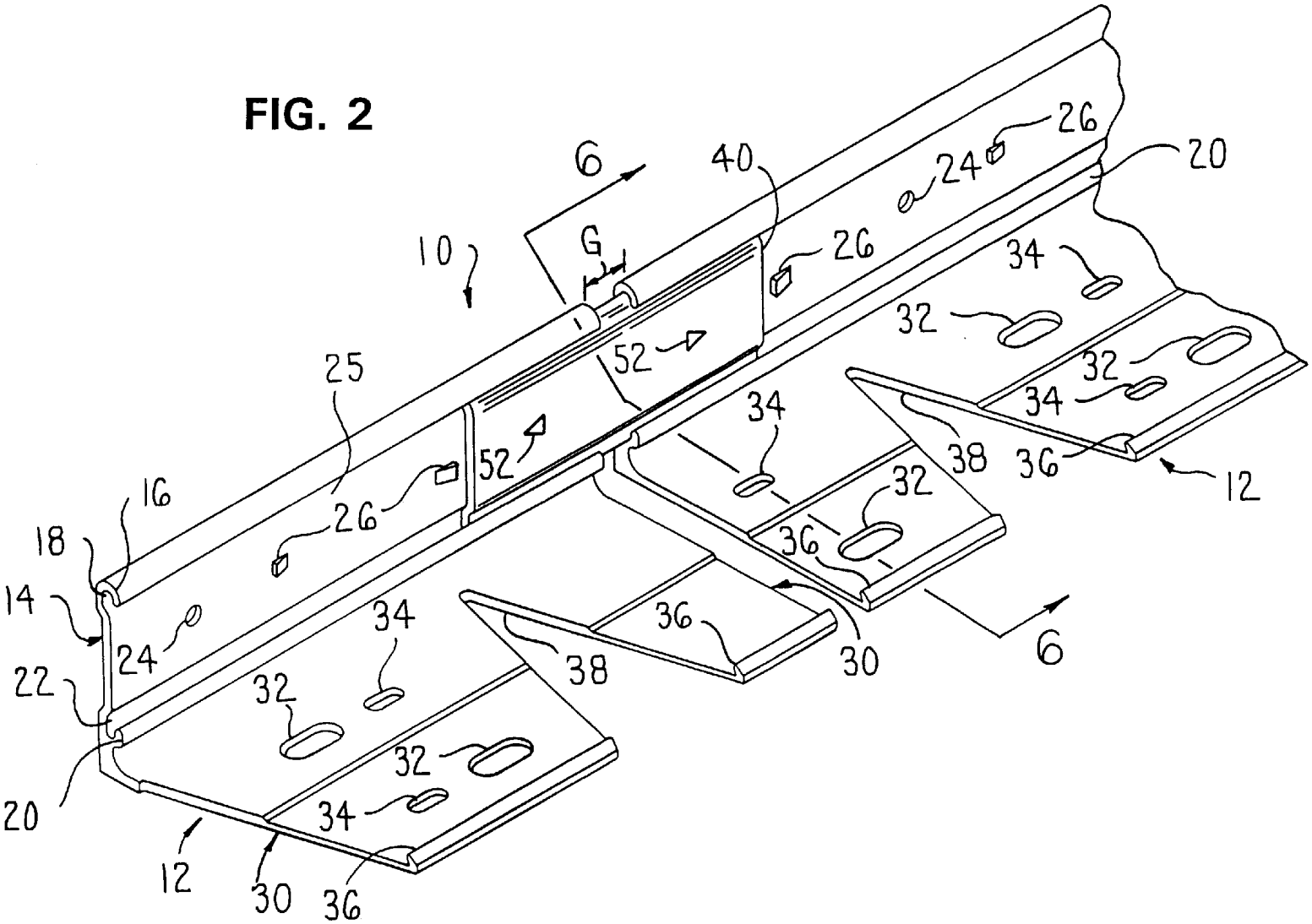
FIG. 2 is an isometric view of the pavement restraint structure showing the elements joined together.
Figure 4:
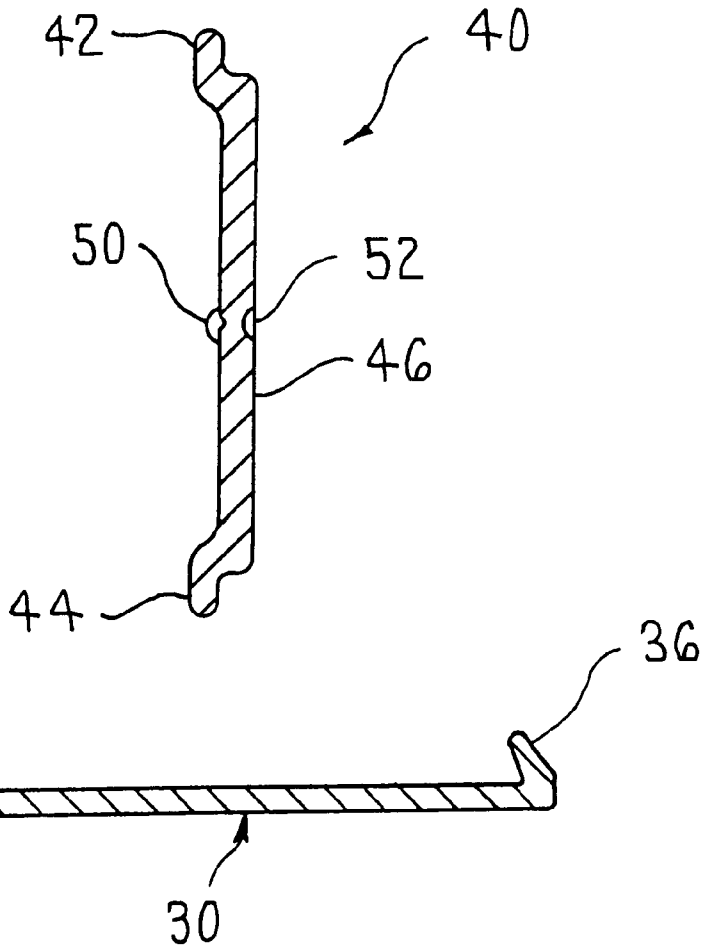
FIG. 4 is a cross-sectional view of a connecting element of the pavement restraint structure.

The edging portion 14 of the edging piece 12 includes an upper lip 16 extending coextensively along the length at the top edge of the edging portion. The upper lip 16 is formed such that the length near the top of the edging portion 14 extends outwardly, and the edge at the top extends inwardly and downwardly as shown in FIG. 3. This formation of the upper lip 16 creates an upper slot 18. A lower lip 20 is formed along the length of the edging portion 14 at a location near, but above, the bottom edge thereof. The lower lip 20 has a similar shape as the upper lip 16. The lower lip 20 forms a lower slot 22 extending along the entire length of the edging portion 14. As shown in FIG. 3, the edging portion 14 has a central section 25 between the lower lip 20 and the upper lip 16 extending inwardly with respect to the bottom of the edging portion 14 and the lips 16, 20 thereof. This arrangement functions to create slots 18, 22 having depth with respect to the central section 25 of the body of the edging portion 14, as shown in FIGS. 3 and 4. Therefore, the slots 18, 22 can better receive and support an element. The lower edge of the edging portion 14 is joined to a longitudinal edge of the support portion 30 of the edging piece 12 as shown in FIGS. 1–3.

The edging portion 14 of the edging piece 12 also includes spaced edging surface depressions formed by apertures 24. The spaced edging apertures 24 are both spaced the same given distance from opposing ends 5 of the edging piece 12. The edging portion 14 also includes blocking tabs 26 spaced equidistantly inwardly from the edging apertures 24 at the central section 25 of the edging piece 12 as shown in FIG. 1. Thus, the distances from respective ends of the edging piece 12 to the blocking tabs 26 are equivalent. Therefore, the edging aperture 24 and the blocking tab 26 on the right side of the edging piece 12 are a mirror image of the edging aperture 24 and the blocking tab 26 on the left side of the edging piece 12.

The support portion 30 of the edging piece 12 generally can have a greater thickness near the longitudinal edge joined to the edging portion 14 as shown in FIG. 3. The support portion 30 can include large support apertures 32 and small support apertures 34 as shown in FIG. 1. The support apertures 32, 34 are slotted and extend farther along the length of the support portion 30 than the width thereof, as shown in FIG. 1. The support apertures 32, 34 preferably have a raised beveled surface thereabout on the top surface of the support portion 30 to assist sliding or longitudinal movement of the edging piece 12 with respect to an anchoring element. The support apertures 32, 34 can be located at various positions and locations across and along the support portion 30. The exemplary arrangement of FIG. 1 shows support apertures 32, 34 located at both the thick and thin areas of the support portion 30.

Support portion 30 also includes an inwardly inclined support lip 36 located along the length of the support portion at an outside edge disposed away from the edge joined to the edging portion 14.

Support portion 30 can also include V-shaped cut-outs 38. The V-shaped cut-outs 38 open at the outside edge of the support portion 30 of the edging piece 12. The V-shaped cut-outs 38 can be premanufactured as part of the edging piece 12, or made by a user installing the edging piece 12.

In some embodiments, the top surface of the support portion 30, as well as the inside surface of the edging portion 14, can be grooved and/or textured to allow hot asphalt and adhesive material to bond to the restraint structure 10. The bottom surface of the support portion 30 can also be grooved or textured to assist in bonding the support portion to an existing layer of asphalt. In such instances, adhesive can be applied to the restraint structure 10 before placement on a support bed or application of paving material thereon.

All of the edging pieces 12 of the restraint structure 10 generally have the same characteristics. The number and positions of the support apertures 32, 34 can vary as shown in FIG. 1. However, the upper and lower slots 18, 22, the edging apertures 24, and the blocking tabs 26 must be at substantially the same positions on all of the edging pieces 12 for proper operation of the restraint structure 10.

The restraint structure 10 includes a connecting element 40 shown in FIG. 1. As best shown in FIG. 3, the connecting element 40 includes an upper curved top portion 42 along a length of the top edge thereof and a lower curved bottom portion 44 along the length of the bottom edge thereof. The curved top portion 42 and the curved bottom portion 44 have a connecting element body portion 46 therebetween. The body portion 46 is disposed inwardly from the top portion 42 and bottom portion 44. The curved top portion 42 and curved bottom portion 44 of the connecting element 40 are shaped to fit in upper slot 18 and lower slot 22, respectively. Thus, the connecting element 40 secures first and second edging pieces 12 to each other as illustrated in FIG. 2.

The curved top portion 42, curved bottom portion 44, and body portion 46 of the connecting element 40, preferably comprise an integral element made out of the same, or a similar material or metal as the edging pieces 12 and an extrusion.

Figure 5:
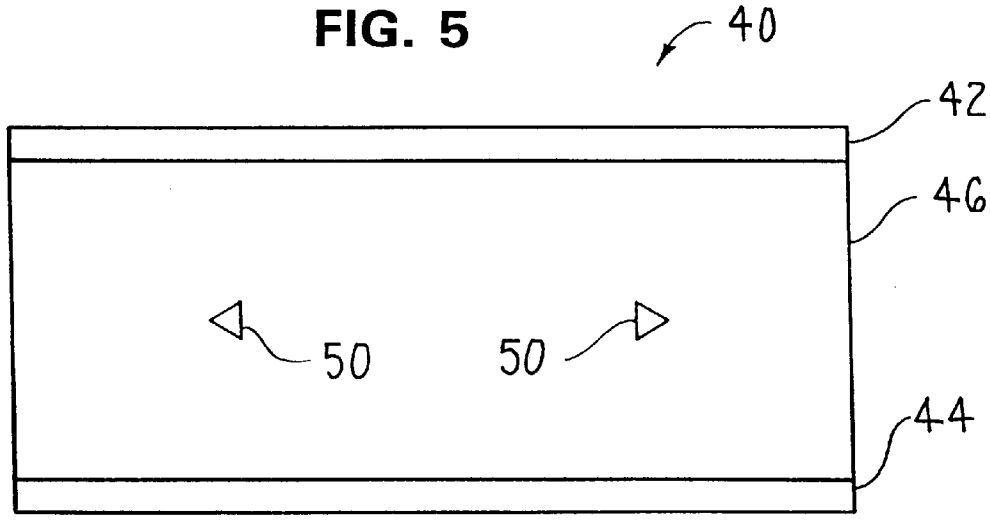
FIG. 5 is a front view of the connecting element viewed from an opposing side to that shown in FIG. 1.

The connecting element 40 also includes protrusions 50 extending outwardly at opposing spaced locations as shown in FIGS. 4 and 5. The protrusions 50 secure the connecting element 40 to respective edging pieces 12 by entering edging apertures 24. In such an arrangement, the protrusions 50 secure the connecting element 40 to adjacent edging pieces 12 as shown in FIG. 2. The respective distances of the protrusions 50 from ends of the connecting element 40 and the given distances of each of the edging apertures 24 from ends of the edging pieces 12 cause adjacent edging pieces 12 connected by a connecting element 40, to have a gap G as shown in FIG. 2. The gap G enables edging pieces 12 of a pavement restraint structure 10 to expand longitudinally along lengths thereof in response to changes in temperature, for example, the sudden increased temperature when hot asphalt is applied thereto. Such hot asphalt greatly expands the edging pieces 12, substantially closing the gaps G. Other instances include below freezing temperatures and hot temperatures. Expansion in a longitudinal direction maintains the pavement supported by the restraint structure 10 while preventing damage to the restraint structure 10. Gap G preferably is about ⅜ of an inch. However, other greater or lesser distances can be appropriate. Gap size G is especially dependent on the overall length, such as eight feet, of the individual edging pieces 12. Generally, the gap size is greater than about ⅛ of an inch.

The blocking tabs 26 also enable expansion of the gap G or longitudinal expansion of the edging pieces 12 along the length thereof by enabling movement of a first protrusion 50 out of the edging aperture 24 and along the length of the edging portion 14 a given distance before contacting blocking tab 26. Thus the edging pieces 12 can move beyond the edging aperture 24 a given distance, for example, equivalent to gap G, so that longitudinal expansion along the length of the restraining structure 10 is permitted. The protrusion 50 on the other end of the connecting element 40 is a mirror image of the first protrusion on the other end that correspondingly enables expansion of another edging portion 14 of another edging piece 12.

The protrusions 50 can be formed by a punch striking a surface of the connecting element 40 and forming an indentation or depression 52 in direct opposition to the protrusion. This arrangement is illustrated in FIGS. 1 and 4.

As shown in FIG. 5, the opposing protrusions 50 generally are not circular in shape, but have a narrow width on the outward edge thereof tapering outwardly to a greater width on the inside edge of the protrusions. In this manner, movement of the connecting element 40 into the slots 18, 22 is less difficult. However, after the protrusions 50 of the connecting element 40 are seated in respective edging apertures 24, the greater width on the inward edge of the protrusion 50 makes removal of the connecting element 40 or movement or thermal expansion toward removal of the connecting element more difficult. As described earlier, the connecting element 40 can, in some instances, move beyond the edging aperture 24 and into contact with the blocking tab 26 due to lateral forces on the restraint structure 10 caused by changes in ambient temperature (thermal expansion) or the like.

Figure 6:
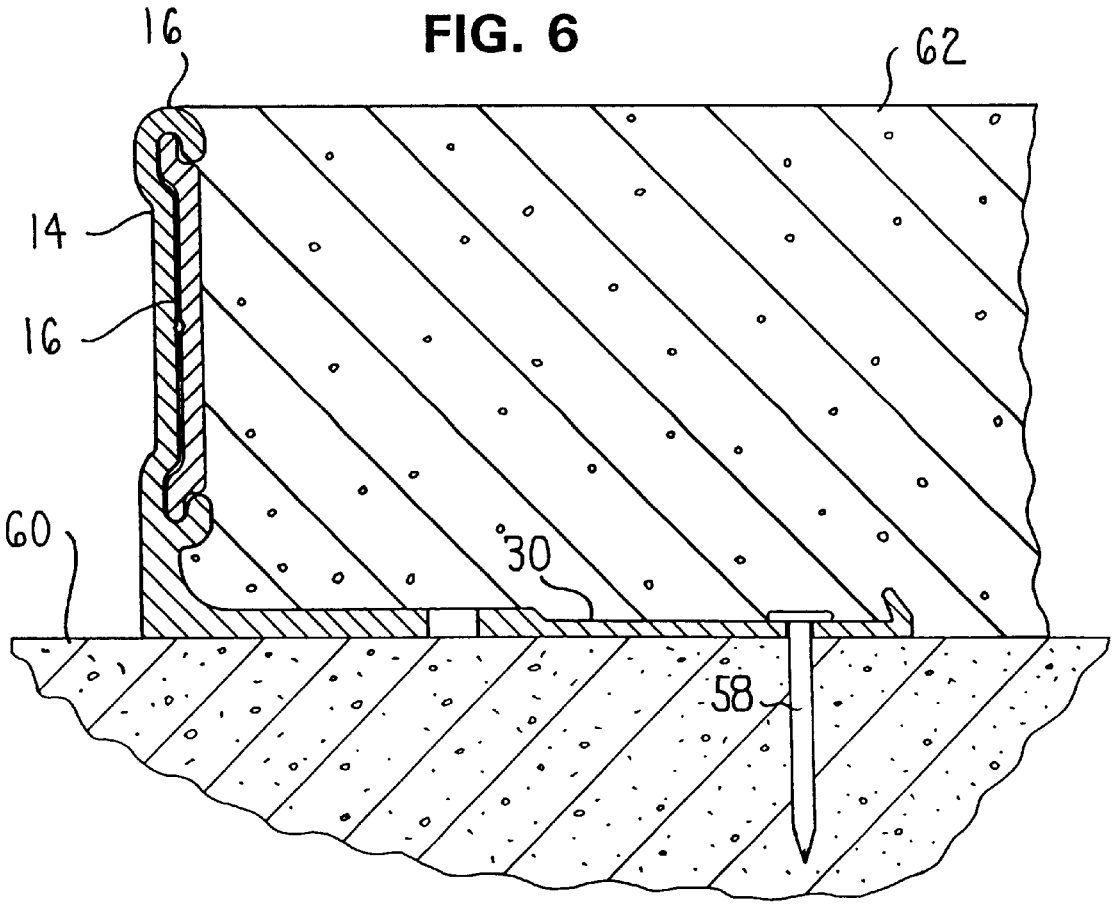
FIG. 6 is a sectional view showing the pavement restraint structure preventing asphalt from moving significantly outward from an edging portion of the angled edging piece.

An anchoring element 58 such as a metal spike, shown in FIG. 6, secures the support portion 30, and thus the edging piece 12 to a support bed or base 60 of gravel, sand, dirt, or new softer asphalt, or a combination thereof. When metal spikes are utilized, the large support apertures 32 receive the spikes. The slotted shape of the large support apertures 32 enable the edging pieces 12 to laterally move along lengths thereof. Such movement assists in preventing destruction of the restraint structure 10 or outward shifting of asphalt in response to changes in ambient temperature.

The anchoring element 58 can also comprise concrete nails or screws, having a narrower diameter than a spike, that secure the support portion 30 of the edging piece 12 to a support bed comprising pavement such as concrete or hard asphalt. Such concrete nails or screws utilize the small support apertures 34. The slotted shape of the small support apertures 32 enable the edging pieces 12 to move laterally or longitudinally along lengths thereof. In such an arrangement, the restraint structure provides edging when pavement is resurfaced.

Assembly and installation of the pavement restraint structure 10 requires the following steps. First, the angled edging pieces 12 are arranged adjacent each other and connected together by sliding the connecting element 40 into respective slots 18, 22 at ends of the respective edging pieces 12. Opposing ends of the connecting element 40 are received by the slots 18, 22. The connecting element 40 is forced onto and slides into the slots 18, 22 until one protrusion 50 thereon is aligned with a respective edging aperture 24 of the edging piece 12. Respective edging apertures 24 and protrusions 50 secure the connecting element to adjacent edging pieces 12. The process can be repeated for a plurality of edging pieces 12. However, a gap G remains between adjacent edging pieces 12 after connection by the connecting element 40. The gap G enables lateral movement along the length of the restraint structure 10 in response to changes in temperature.

The support portions 30 of the edging pieces 12 are then secured to a support bed or base 60 by anchoring elements 58 as described earlier.

The pavement, here asphalt, 62 is applied to cover the support portion 30 of the respective edging pieces 12 of the restraint structure 10. As shown in FIG. 6, the pavement 62, comprising asphalt, cement, or the like, generally does not cover the upper lip 16 of the edging portion 14. If the pavement 62 does cover the lip 16, it is only a small layer of residual asphalt.

The applied pavement is extremely hot and the combination of the gaps G and the slotted apertures 32, 34 enable thermal expansion of the edging pieces 12. As the asphalt cools, the edging pieces 12 return to their original position. The structure 10 thus becomes an integrated system, in combination with the asphalt 62. When the asphalt thermally expands, the restraint structure 10 expands because of the gaps G and the slotted apertures 32, 34. Both the gaps G and apertures 32, 34 are important to obtaining successful results. The support lip 36 receives applied pavement 62, and when the pavement is set, assists in preventing movement of the pavement restraint structure 10 away from the pavement because the support lip 36 digs into the applied asphalt and receives significant downward and outward pressure thus better securing the restraint structure 10. Thus movement of the asphalt outwardly from the edging portion and toward or into adjacent sod is prevented.

After the pavement 62 is applied, a roller unit is driven at a distance about six inches inwardly from and along the length of the restraint structure 10 compacting the asphalt. Then the roller unit can be driven along and over the length of the payment restraint structure 10. The previously compacted asphalt supports the roller unit and prevents damage to the restraint structure 10. The upper lip 16 of the edging portion 14 acts as a knife essentially cutting any asphalt extending outwardly of the restraint structure 10. Then pieces or chunks of asphalt outside of the edging piece can be removed while retaining the asphalt inward of the upper lip 16. Therefore the upper lip 16 of edging portion 14 is generally exposed.

While not shown in FIG. 6, in many embodiments dirt, sand, gravel, sod, or other materials are placed adjacent the outside edge of the edging portion 14 of the edging piece 12 at a height substantially equivalent to the height of the applied pavement 62.

An additional step of forming corners in the edging pieces 12 can be done by cutting the support portions to form V-shaped cut-outs 38 therein as shown in FIGS. 1 and 2. Such cut-outs 38 can be premade in the edging pieces 12. Then the edging pieces 12 are bent to form desired angles for respective corner pieces before installation.

In the above manner, the pavement restraint structure 10 can be quickly installed. Further, the novel arrangement allowing thermal expansion of the edging pieces 12 along the length thereof, provides the pavement restraint structure 10 with a longer life, especially in climates having dramatic changes in seasonal temperatures.

If desired, the surface depressions 24 blocking tabs 26 and indentations 52 can be eliminated, provided the installer is properly instructed to provide this requisite gap between the mutually adjacent ends of the edging pieces 12 during assembly.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A pavement restraint structure for providing an attractive edging and preventing outward movement of pavement, said pavement restraint structure comprising:

a plurality of angled edging pieces each having a support portion and an edging portion, said support portion and said edging portion being substantially perpendicular with respect to each other, said edging portion having upper and lower slots extending substantially horizontally along a length thereof, said edging portion including spaced edging depressions along the length thereof; and connecting elements slidable into the slots of said edging portions of said edging pieces, said connecting elements each including spaced protrusions for connecting respective adjacent said edging pieces by being received in respective said edging depressions of edging portions of adjacent said edging pieces;

wherein said connecting elements and said edging pieces, when assembled, comprise said pavement restraint structure;

wherein said connecting elements connect adjacent said edging pieces such that a gap exists between said adjacent edging pieces and said support portion includes apertures thereon.

2. The pavement restraint structure of claim 1, wherein said support portion has along and parallel to an edge thereof remote from said edging portion an upwardly extending lip.

3. A pavement restraint structure for providing an attractive edging and preventing outward movement of pavement, said pavement restraint structure comprising:

a plurality of edging pieces each having a support portion and an edging portion, said support portion and said edging portion being substantially perpendicular with respect to each other, said edging portion having upper and lower slots extending substantially horizontally along a length thereof and said support portion having support apertures;

connecting elements slidable into the slots of said edging portions of said edging pieces to form said pavement restraint structure, said connecting elements connecting respective adjacent said edging pieces while maintaining a gap between said adjacent edging pieces; and an upstanding lip oriented on said support portion and extending along a length of each said edging portions.

4. The pavement structure of claim 3, wherein the gap between adjacent said edging pieces comprises about ⅜ of an inch and the support apertures are slotted in a longitudinal direction corresponding to the length of said edging pieces.

5. The pavement restraint structure of claim 3, wherein the connecting element includes spaced protrusions extending toward the edging portions of respective adjacent said edging pieces.

6. The pavement restraint structure of claim 5, wherein the edging portions of respective adjacent edging pieces each include edging depressions for receiving said spaced protrusions, said spaced protrusions and said edging depressions securing said connecting element to adjacent said edging portions of respective adjacent edging pieces such that the gap is maintained therebetween, the gap enabling longitudinal expansion of said edging pieces in response to temperature changes such that said pavement restraint structure is not destroyed or weakened by the temperature changes.

7. The pavement restraint structure of claim 6, wherein said edging portions of said respective adjacent edging pieces include blocking tabs spaced inwardly from respective said edging depressions, said blocking tabs preventing movement of said connecting element beyond a given distance from respective said edging depressions.

8. The pavement restraint structure of claim 7, wherein the given distance comprises about ⅜ of an inch.

9. The pavement restraint structure of claim 3, wherein said support portions include support apertures for receiving anchoring elements to secure said edging pieces to a support bed.

10. The pavement restraint structure of claim 9, wherein said support apertures have a greater diameter along the length of said support portions such that said edging pieces can move laterally along lengths thereof, without interference from said anchoring elements, due to expansion caused by temperature changes so that said pavement restraint structure is not destroyed or weakened by the expansion.

11. A pavement restraint structure for providing an attractive edging and preventing outward movement of pavement, said pavement restraint structure comprising:

a plurality of angled edging pieces each having a support portion and an edging portion, said support portion and said edging portion being substantially perpendicular with respect to each other, said edging portion having an upper lip extending inwardly and downwardly toward a side having said support portion, said edging portion having a lower lip extending inwardly and upwardly toward said upper lip, said upper and lower lips forming respective upper and lower slots extending parallel to each other along the length of said edging portion of said edging piece; and connecting elements having a length and a height, said connecting elements each having a curved and downwardly extending top portion at a top edge thereof and extending along the length of said respective connecting elements, said connecting elements each having a curved and upwardly extending bottom portion at a bottom edge thereof and extending along the length of said respective connecting elements;

wherein said top portion and said bottom portion of each said connecting element are received by respective said upper slots and respective said lower slots of respective said adjacent edging portions of said edging pieces to provide said pavement restraint structure;

wherein said connecting elements include protrusions spaced along the length thereof, and said edging portions of said edging pieces include edging depressions for receiving said protrusions and securing respective said connecting elements to adjacent said edging pieces while maintaining a gap between said adjacent edging pieces; and wherein said support portion has along and parallel an edge thereof remote from said edging portion an upwardly extending and inwardly inclined lip.

12. The pavement restraint structure of claim 11, wherein said bottom portion of said connecting element is spaced upwardly from said support portion of said edging piece.

13. The pavement restraint structure of claim 11, wherein said support portion and said edging portion are integral and joined at a bottom edge along a length of said edging portion, thus forming an L-shaped edging piece.

14. A method of assembling and installing a pavement restraint structure comprising:

arranging angled edging pieces adjacent each other, said angled edging pieces each having a support portion and an edging portion, the support portion and the edging portion being at a substantially perpendicular angle with respect to each other;

securing the pieces to each other by sliding a connecting element into slots at ends of the respective edging pieces;

forcing the edging pieces toward each other such that a gap remains between the edging pieces;

securing the support portions of the edging pieces to a support bed for the pavement;

applying a compactible pavement to cover the support portion of the respective edging pieces of the restraint structure;

driving a pavement compacting device along the length of the pavement restraint structure no less than about six inches from the edging portion; and then driving the pavement compacting device over an upper lip of the edging portion of the edging piece.

15. The method according to claim 14, wherein the support bed comprises existing asphalt and the support portions of the edging pieces are secured to the existing asphalt, near an edge thereof, by concrete nails or screws.

16. The method according to claim 14, wherein the support bed comprises an aggregate base and the support portions of the edging pieces are secured to the aggregate base by steel spikes.

17. The method according to claim 14, including the step of forming corners in the edging pieces by cutting the support portions to form V-shaped cut-outs therein and bending the edging pieces to form a desired angle for the respective corner.

18. The method according to claim 14, wherein said compactible material is asphalt.

19. A pavement restraint structure for providing an attractive edging and preventing outward movement of pavement, said pavement restraint structure comprising:

a plurality of edging pieces each having a support portion and an edging portion, said support portion and said edging portion being substantially perpendicular with respect to each other;

at least one connecting element for facilitating an interconnecting of mutually adjacent ends of said edging pieces to form said pavement restraint structure, said at least one connecting element having a spacer mechanism for providing a gap between said adjacent edging pieces during assembly; and an upstanding lip oriented on said support portion and extending along a length of each said edging portion.

20. The pavement restraint structure of claim 19, wherein said edging portion of each said edging piece has upper and lower slots extending substantially horizontally along a length thereof, and wherein said at least one connecting element is configured to slide into the slots of at least one of said edging portions to facilitate said interconnecting of mutually adjacent ends of said edging pieces.

21. The pavement restraint structure of claim 20, wherein said at least one connecting element is separate from said edging pieces and is configured to slide into the slots on both of said edging portions.

22. The pavement restraint structure of claim 20, wherein the gap between adjacent said edging pieces comprises about ⅜ of an inch.

23. The pavement restraint structure of claim 20, wherein the connecting element includes spaced protrusions configured to engage edge portions of respective adjacent said edging pieces to establish a boundary for said gap.

* * * * *